US009332819B2

(12) United States Patent
Samain et al.

(10) Patent No.: US 9,332,819 B2
(45) Date of Patent: May 10, 2016

(54) APPLICATOR FOR APPLYING COSMETIC PRODUCT ON THE LIPS OF A USER AND ASSOCIATED APPLICATION METHOD

(71) Applicant: L'OREAL, Paris (FR)

(72) Inventors: Henri Samain, Bievres (FR); Franck Giron, Lagny sur Marne (FR); Chrystele Gevrey, Sucy en Brie (FR)

(73) Assignee: L'OREAL, Paris (FR)

( * ) Notice: Subject to any disclaimer, the term of this patent is extended or adjusted under 35 U.S.C. 154(b) by 0 days.

(21) Appl. No.: 14/346,874

(22) PCT Filed: Sep. 20, 2012

(86) PCT No.: PCT/EP2012/068489
§ 371 (c)(1),
(2) Date: Mar. 24, 2014

(87) PCT Pub. No.: WO2013/045332
PCT Pub. Date: Apr. 4, 2013

(65) Prior Publication Data

US 2014/0290684 A1 Oct. 2, 2014

Related U.S. Application Data

(60) Provisional application No. 61/543,935, filed on Oct. 6, 2011.

(30) Foreign Application Priority Data

Sep. 26, 2011 (FR) ..... 11 58571

(51) Int. Cl.
*A45D 40/30* (2006.01)
*A45D 40/26* (2006.01)

(52) U.S. Cl.
CPC ..... *A45D 40/30* (2013.01); *A45D 40/26* (2013.01)

(58) Field of Classification Search
CPC ..... A45D 40/30; A45D 40/26
USPC ..... 132/317, 318, 320, 319
See application file for complete search history.

(56) References Cited

U.S. PATENT DOCUMENTS

| | | | | |
|---|---|---|---|---|
| 2,784,721 | A * | 3/1957 | Davis | 132/320 |
| 2011/0067718 | A1* | 3/2011 | Lee | 132/200 |
| 2012/0055498 | A1* | 3/2012 | Haddad | 132/200 |

FOREIGN PATENT DOCUMENTS

WO WO-2007006559 A1 1/2007

* cited by examiner

*Primary Examiner* — Rachel Steitz
(74) *Attorney, Agent, or Firm* — Polsinelli PC

(57) ABSTRACT

This applicator comprises an application surface (16), the application surface (16) having a central region (22) and a peripheral contour line (24) analogous to the contour of the lips of a human being. The central region (22) and the peripheral line (24) being intended to receive the cosmetic product. The peripheral line (24) comprises preferred means (26) for application of the cosmetic product on the lips of the user for applying, opposite the peripheral line (24), a surface mass of cosmetic product that is greater than the surface mass applied opposite the central region (22).

20 Claims, 3 Drawing Sheets

APPLICATOR FOR APPLYING COSMETIC PRODUCT ON THE LIPS OF A USER AND ASSOCIATED APPLICATION METHOD

CROSS REFERENCE TO RELATED APPLICATIONS

This application is a National Phase filing under 35 U.S.C. §371 of PCT/EP2012/068489 filed on Sep. 20, 2012; and this application claims priority to Application No. 1158571 filed in France on Sep. 26, 2011; and this application claims the benefit of U.S. Provisional Application No. 61/543,935 filed on Oct. 6, 2011; the entire contents of all are hereby incorporated by reference.

TECHNICAL FILED

This invention relates to an applicator for applying cosmetic product on the lips of a user, of the type including an application surface, in which the application surface has a central region and a peripheral contour line analogous to the contour of the lips of a human being, with the central region and the peripheral line being intended to receive the cosmetic product.

The cosmetic product is, for example, a makeup product for the lips, such as a lip coloring product. More generally, a "cosmetic product" is a product as defined in particular in Directive 93/35 EEC of the Council, dated 14 Jun. 1993.

BACKGROUND

To apply a makeup product on the lips of a user, it is known to use a lipstick to transfer the product by gliding.

Such a mode of transfer is effective, but is not always precise, in particular where the contour is produced.

When in a hurry, the user will generally avoid using long-lasting or vibrantly colored products so as not to waste time if they need to be retouched.

In addition, to obtain a very satisfactory return, the user may, when there is time, use a liner to produce the contour, and a conventional lipstick to cover the interior portion of the lips.

This makeup method is not entirely satisfactory, since it is time consuming and tedious to implement. In addition, the contour is often more resistant than the interior portion to wear, which sometimes produces an unaesthetic change in the makeup over time.

To overcome this problem, it is known, for example from documents FR 752 860, U.S. Pat. Nos. 2,279,781, 2,207,959, FR 663 805, U.S. Pat. Nos. 2,412,073, 3,308,837, 2,735,435, 1,556,744, 2,248,533, 2,416,029, 1,944,691, 1,782,911, 2,554,965, 2,199,720, WO 2008 013 608 and US 2003 209 254, to use makeup application buffers that have a shape substantially complementary to the shape of the lips.

Such buffers make it possible to apply the makeup product by pressure, and not by gliding. The contour line obtained is therefore generally neater than that obtained with a conventional lipstick.

However, the applicators described in these documents are not entirely satisfactory. Indeed, although the buffer systems improve the results in certain cases, it is sometimes necessary to correct imperfections by pinching the lips. However, the drawing line at the upper portion of the contour of the lips, in particular at the "Cupid's bow", is altered.

In particular, the buffer systems do not provide an entirely neat result at the Cupid's bow. In this area, the contour line is not neat, and the surface is overloaded.

Conversely, in some cases, the central surface is done well, but the drawing line and the contour line are imperfect.

To overcome this problem, it is possible to be assisted by an aesthetician, or to take the time to produce a neat drawing line with a corrective pencil, thereby making the makeup operation tedious.

SUMMARY

One objective of the invention is therefore to provide an applicator that makes it possible to deposit the cosmetic product simply and quickly on the lips of a user by producing a uniform colored surface and a neat contour.

To this end, the invention relates to an applicator of the type mentioned above, characterized in that the peripheral line comprises means for preferred application of cosmetic product on the lips of the user so as to apply, opposite the peripheral line, a surface mass of cosmetic product greater than the surface mass applied opposite the central region.

The applicator according to the invention may include one or more of the following features, taken alone or in any technically possible combination:

- the peripheral line extends between an exterior edge externally defining the application surface and an interior contour edge that is substantially homothetic to the contour of the exterior edge;
- the maximum width of the peripheral line, measured perpendicularly to a longitudinal axis of extension of the application surface, is less than 20% of the maximum width of the central region, measured perpendicularly to the axis of extension;
- the maximum width of the peripheral line, measured perpendicularly to an axis of extension of the application surface is less than 4 mm;
- the preferred application means comprise a gutter extending advantageously over the entire contour of the peripheral line;
- the preferred application means comprise an absorbing surface arranged advantageously over the entire contour of the peripheral line;
- the preferred application means are formed by an area having a greater wettability than the wettability of the central region, with the area extending advantageously over the entire contour of the peripheral line;
- the preferred application means comprise an energy supply assembly on the peripheral line, in particular a peripheral line heating member;
- the preferred application means comprise an assembly for dispensing cosmetic product on the peripheral line, with the applicator including a cosmetic product container connected to the dispensing assembly;
- the central region is substantially solid;
- the central region defines a cavity comprising an upper concave space and a lower concave space;
- the central region and the peripheral line are covered with cosmetic product;
- the peripheral line comprises a substantially convex lower segment and an upper segment having two convex lateral regions and a central convex recess.

The invention also relates to a method for applying cosmetic product on the lips of a user, including the following steps:

- providing an applicator as described above, with the central region and the peripheral region being covered with cosmetic product;
- applying the application surface on the lips of a user;

depositing cosmetic product on the lips of a user, with the surface mass of cosmetic product deposited opposite the peripheral line being greater than the surface mass of cosmetic product deposited opposite the central region.

The method according to the invention may include one or more of the following features, taken alone or in any technically possible combination:

it comprises, before the provision step, the application by the user of a cosmetic product on the application surface.

BRIEF DESCRIPTION OF THE DRAWINGS

The invention will be easier to understand in view of the following description, provided solely by way of an example, and in reference to the appended drawings, in which.

BEST AND VARIOUS MODES

Figure 1:
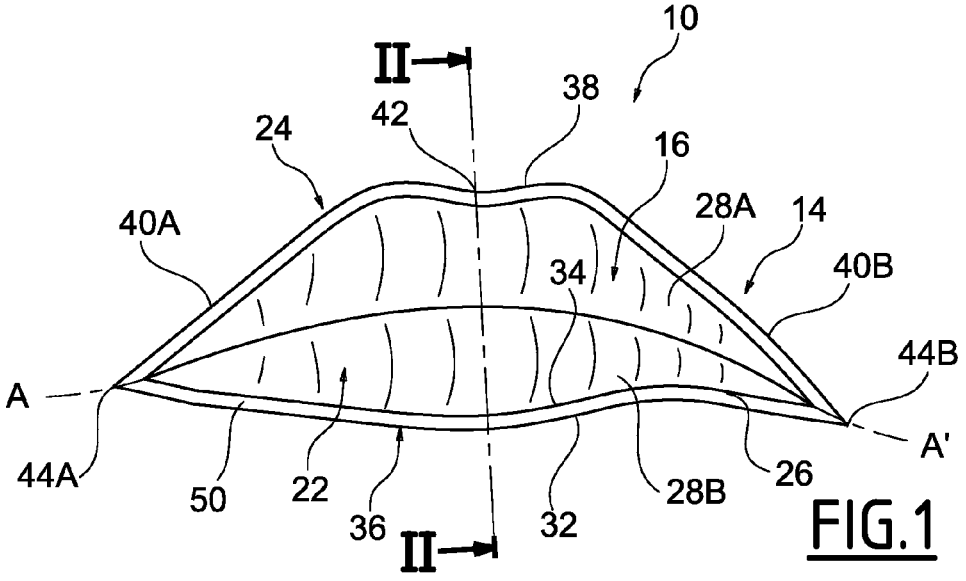
FIG. 1 is a front view of a first cosmetic product applicator according to the invention.
Figure 2:
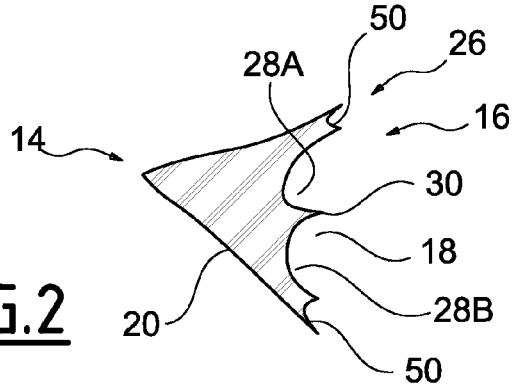
FIG. 2 is a cross-section view according to the transverse plane II of FIG. 1.

A first cosmetic product applicator 10 according to the invention is shown in FIGS. 1 and 2. This applicator 10 is intended to apply the cosmetic product on the lips of a user, according to the contour of the lips.

The cosmetic product is, for example, a product for makeup of the lips such as a lip coloring product. The product is in fluid form, in particular liquid or gel form. Alternatively, the cosmetic product is formed by a solid or a cream.

As shown in FIGS. 1 and 2, the applicator 10 comprises a body 14 defining a surface 16 for application of the cosmetic product on the lips. The surface 16 is advantageously defined in a cavity 18 of the body 16 with a shape complementary to that of the lips of a user.

The body 14 also has a rear portion 20 intended for gripping of the applicator 10 by the fingers of a user.

As shown in FIG. 1, the application surface 16 includes a hollow central region 22 and a peripheral line 24 having a shape matching the contour of the lips of a human being.

According to the invention, the peripheral line 24 is equipped with means 26 for preferred application of cosmetic product on the lips of the user.

The central region 22 comprises two concave spaces 28A, 28B with a shape respectively complementary to the upper lip and to the lower lip of a user. The concave spaces 28A, 28B are defined by an intermediate projection 30 intended to be inserted between the lips and extending substantially along a horizontal axis A-A' of extension of the applicator 10.

The central region 22 is solid or substantially solid.

By substantially solid, we mean that the maximum span of the openings that are provided in this surface is less than 75%, and preferably less than 40%, of the total span of the central region 22, when projected in a vertical plane passing through axis A-A'.

Thus, when the cosmetic product is placed in the central region 22, it is capable of being applied substantially over the entire surface of the user's lips, in order to cover this surface.

The peripheral line 24 extends around the central region 22. It is defined outwardly by an exterior edge 32 and inwardly by an interior edge 34 with a shape that is substantially homothetic to the exterior edge 32.

The maximum width of the peripheral line 24, measured perpendicularly to the axis of extension A-A-', is less than 20% of the maximum width of the central region 22, measured perpendicularly to axis A-A.

The maximum width of the peripheral line 24 is thus generally less than 4 mm.

Then, the surface occupied by the peripheral line, when projected in a vertical plane passing through axis A-A', is less than 20% of the surface occupied by the central region 22, in the same plane.

The peripheral line 24 defines a contour of the application surface 16, with a shape analogous to that of the lips of a user.

Thus, the line 24 comprises a lower curved and generally convex segment 36 and an upper segment 38 extending on each side of axis A-A'. The upper segment 38 has two convex regions 40A, 40B between which a central recess 42 is provided, intended to reproduce the Cupid's bow shape of the lips.

The lower 36 and upper 38 segments converge to form a point at the corners of the mouth 44A, 44B located substantially on axis A-A'.

In the embodiment of FIGS. 1 and 2, the preferred application means 26 are formed by a peripheral gutter 50 enabling the cosmetic product to accumulate.

The peripheral gutter 50 advantageously has a maximum depth substantially equal to the thickness of the line 24. This depth is, for example, greater than 0.5 mm, preferably greater than 1 mm and is in particular between 0.5 and 3 mm.

The gutter 50 is defined laterally by the exterior edge 32 and the interior edge 34 of the line 24, which project with respect to the base of the gutter 50. It advantageously extends continuously over the entire periphery of the application surface 16, along the entire peripheral line 24.

Thus, as will be seen below, the gutter 50 is capable of receiving and applying a surface mass of cosmetic product that is greater than the surface mass applied by the central region 22, in particular because of the possible accumulation of cosmetic product in the gutter 50.

A method for producing the applicator 10 according to the invention will now be described.

Initially, an impression of the mouth of a user is made using a molding material capable of solidifying. This material is, for example, a cross-linkable material, such as a cross-linkable silicone.

Figure 3:
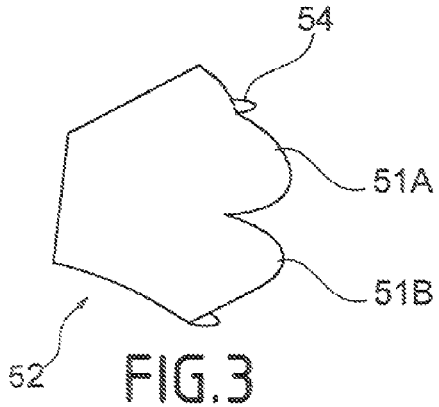
FIG. 3 is a diagrammatic side view of a backing mold intended to form the applicator of FIG. 2.

Then, a backing mold 52 (shown in FIG. 3) is made of a malleable material, in particular a brittle material such as plaster. The backing mold 52 has two longitudinal beads 51A, 51B with a shape analogous to that of the upper and lower lips of the user. A projecting rib 54 is then arranged according to the contour of the lips on a backing mold 52.

Then, the body 14 is produced by molding a block of fluid product capable of solidifying on the backing mold 52.

The material capable of solidifying is, for example, a cross-linkable material, in particular a cross-linkable silicone.

The central region 22 is formed opposite the beads 51A, 51B representing the lips of the user, and the gutter 50 is formed around the rib 54 at the periphery of the central region 22.

Then, the molded body 14 is cut out along the periphery of the lips following the exterior edge 32 of the peripheral line 14.

This applicator is therefore perfectly suitable for use on a given user in order to follow the line of the user's lips.

A method for applying cosmetic product using the applicator 10 will now be described.

Initially, the user grips the body 14 of the applicator 10 by the rear gripping portion 20. The user then deposits the cosmetic product on the application surface 16, covering this entire surface.

The cosmetic product may, for example, be dispensed from a container outside the device 10, in particular by spraying or by using an application tool such as a brush.

In consideration of the presence of the preferred application means 26 at its periphery, and in particular the gutter 50, the specific mass of cosmetic product received at the peripheral line 24 is greater than the surface mass received in the central region 22.

Once the applicator 10 has been filled with cosmetic product, the user brings the application surface 16 into contact with the lips. The user thus inserts the lips respectively into the concave spaces 28A, 28B.

The cosmetic product is then deposited by contact, by producing an imprint on the user's lips.

The entire surface of the user's lips is then covered with cosmetic product, in a simple, fast and inexpensive manner.

In consideration of the presence of the preferred application means 26, the surface mass of cosmetic product deposited opposite the peripheral line 24 is greater, for example at least twice the amount, than the surface mass of cosmetic product deposited opposite the central region.

This deposited surface mass is measured as follows: over a length of 20 mm and over a width I corresponding to the width of the peripheral line, the product applied opposite the peripheral line is collected by scraping. This mass Mline is weighed. The same (same length, same width, same scraping tool) is performed for the product applied opposite the central region (by being placed 5 mm from the peripheral line). This mass Mcentral is weighed.

The experiment is performed 3 times and the Mline/Mcentral ratio is averaged.

This makes it possible to obtain a particularly neat contour line around the user's lips, loading the central region of the lips adequately, without overloading it.

The user can then homogenize the product deposited in the central region without having to approach the contour line by lightly pinching the lips against one another.

Owing to the invention described above, it is not necessary to use a large amount of cosmetic product to obtain a satisfactory result. The result obtained is neat and precise, at the exterior line, and is not overloaded or uncomfortable at the central region.

It is thus possible to use cosmetic products having a high stability, without the risk of deterioration of the makeup, in particular by producing a perfectly neat contour and a substantially ideal drawing line.

The stability over time of the drawing line and the contour is also improved.

The method is especially simple to implement since it requires less than 10 seconds, and even less than 5 seconds of time.

Figure 4:
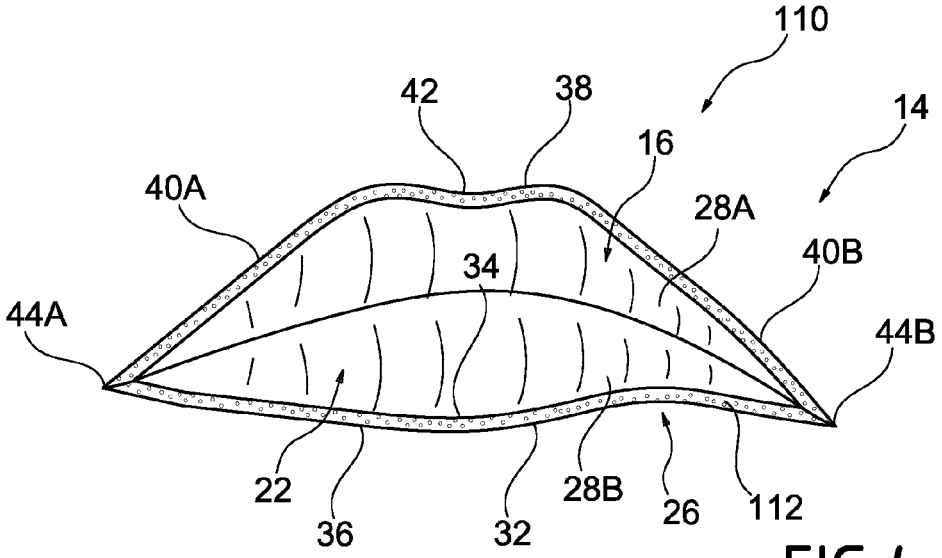
FIG. 4 is a view equivalent to that of FIG. 1 of a second applicator according to the invention.

A second applicator 110 according to the invention is shown in FIG. 4.

Unlike the first applicator 10, the preferred application means 26 are formed by an absorbent material 112 defining the surface 16 at the peripheral line 24. This absorbent material 112 is, for example, an absorbent foam, suitable for retaining a surface mass of product greater than the surface mass of product retained by the central region 22.

As above, the absorbent material 112 forming the preferred application means 26 ensures that the application of a surface mass of cosmetic product opposite the peripheral line 24 is greater than the surface mass applied opposite the central region 22.

The application method implemented using the applicator 110 is also equivalent to that described above.

Figure 5:
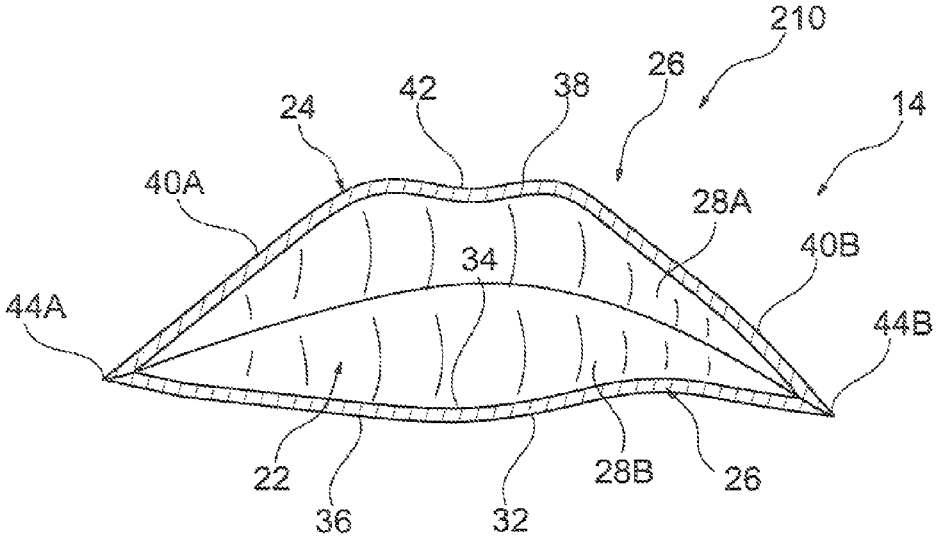
FIG. 5 is a view equivalent to that of FIG. 1 of a third applicator according to the invention.

A third applicator 210 according to the invention is shown in FIG. 5. In this example, the preferred application means 26 are formed by a surface having a wettability on the contour line 24 that is greater than the wettability on the central region 22.

This wettability is characterized by a surface tension, more than 10 $mJ/m^2$ above the surface tension of the central region 22, in particular more than 20 $mJ/m^2$ above the surface tension of the central region 22.

The surface tension is advantageously measured by the method of the contact angle based on the models of GOOD VAN OSS and/or OWENS and WENDT.

One drop of liquid is deposited using a syringe on the surface of the sample to be measured. The measurement of the contact angle is performed using images captured by a PC using a camera. The WINGOUTTE software digitizes the contour of the drop by image processing. It then determines the contact angle using interpolation methods. The WINGOUTTE software uses the polynomial or arc-of-circle interpolation methods to determine the contact angle. After these measurements are obtained, the WINCALC software calculates the different components associated with the GOOD VAN OSS and OWENS WENDT model for the measurements, using 2 to 3 different liquids. In some cases, a powered system makes it possible to measure the advancing angle and the recessing angle of the drop, with the needle of the syringe then being held in the drop. A Plexiglas chamber makes it possible to isolate the sample drop system from the air and exterior contaminations.

The different liquids used to measure the contact angle are, for example, water, glycerol, formamide, ethylene glycol, a-bromonaphthalene, diodomethane, and cis-decalin.

Thus, when the cosmetic product is deposited on the surface 16, before it is applied on the lips, the surface mass of cosmetic product retained on the peripheral line 24 is greater than the surface mass of cosmetic product retained in the central region 22.

The preferred application means 26 are therefore suitable for applying a surface mass of cosmetic product opposite the peripheral line 24 that is greater than the surface mass applied opposite the central region 22.

Figure 6:
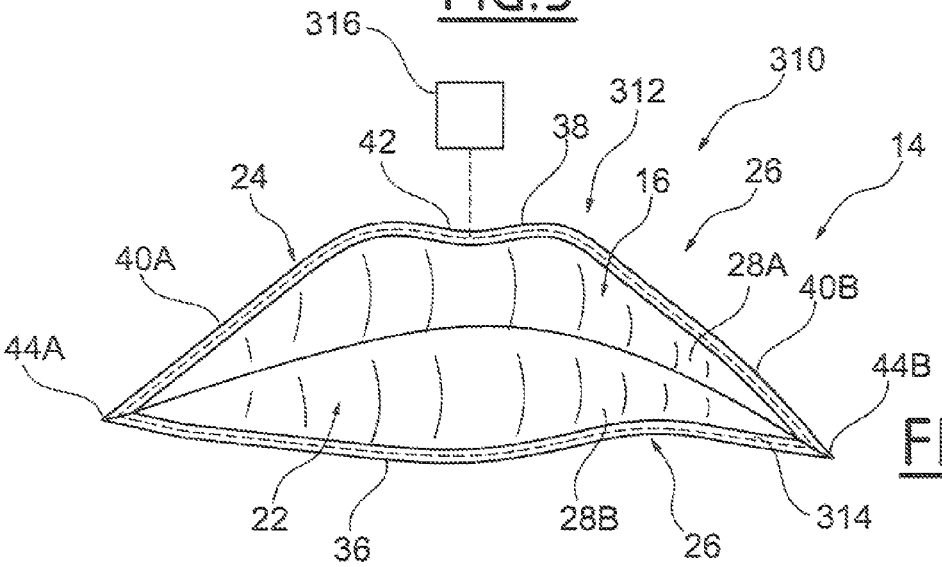
FIG. 6 is a view equivalent to that of FIG. 1 of a fourth applicator according to the invention.

A fourth applicator 310 according to the invention is shown in FIG. 6.

Unlike the first applicator 10, the preferred application means 26 are formed by a energy supply assembly 312 on the contour line 24. This assembly 312 comprises, for example, a member 314 for selective heating of the contour line 24 extending over the entire periphery of the contour line 24. The selective heating member 314 is advantageously powered by an electrical power supply device 316.

When the applicator 310 is used, the heating member 314 is electrically powered by the device 316. The temperature of the surface 16 on the contour line 16 then preferably increases by at least 1° C., more preferably 3% with respect to the temperature of the surface 16 in the central region 22.

When the cosmetic product is deposited on the surface 16, the surface mass of cosmetic product deposited on the contour line 24 is then greater than the surface mass deposited in the central region 22.

The preferred application means 26 are therefore suitable for applying a surface mass of cosmetic product opposite the peripheral line 24 that is greater than the surface mass applied opposite the central region 22.

Figure 7:
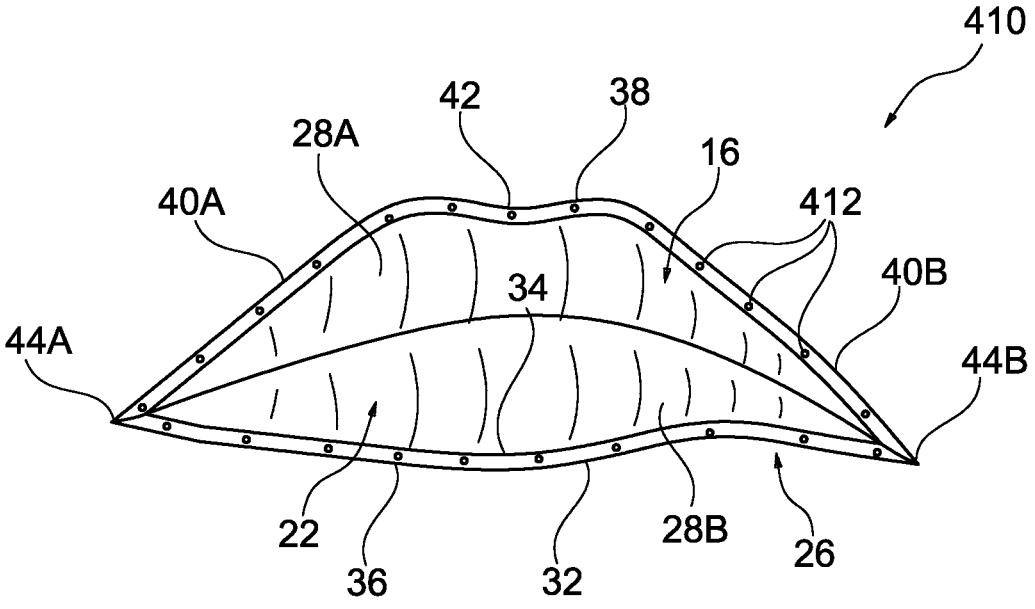
FIG. 7 is a view equivalent to that of FIG. 1 of a fifth applicator according to the invention.

A fifth applicator 410 according to the invention is shown in FIG. 7. Unlike the first applicator 10, the preferred cosmetic product application means 26 comprise a plurality of cosmetic product dispensing orifices 412 distributed along the peripheral line 24. The orifices 412 lead onto the application surface 16. They are connected to a container (not shown) of cosmetic product, for example provided in the body 14.

The orifices 412 are capable of preferably conveying the cosmetic product opposite the peripheral line 24, so that the surface mass of cosmetic product present on the peripheral line 24 is greater than the surface mass of cosmetic product present in the central region 22.

The central region 22 is solid, or also comprises orifices, with a surface density of orifices 412 lower than the surface density of orifices 412 present on the peripheral line 24.

Thus, when the applicator 410 is used, the preferred application means 26 are capable of applying a surface mass of cosmetic product opposite the peripheral line 24 greater than the surface mass applied opposite the central region 22.

In an alternative, a first cosmetic product, having, for example, a first coloring, is applied on the peripheral line 24, and a second cosmetic product having a second coloring different from the first coloring is applied on the central region 22.

The invention claimed is:

1. Applicator for applying cosmetic product on the lips of a user, of the type including an application surface, the application surface having a central region and a peripheral contour line analogous to the contour of the lips of a human being, with the central region and the peripheral line being intended to receive the cosmetic product, wherein the peripheral line comprises means for preferred application of the cosmetic product on the lips of the user for applying, at the peripheral contour line, a mass per unit surface of cosmetic product that is greater than the mass per unit surface of cosmetic product applied in the central region.

2. Applicator according to claim 1, wherein the peripheral line extends between an exterior edge externally defining the application surface and an interior contour edge substantially homothetic to the contour of the exterior edge.

3. Applicator according to claim 2, wherein the maximum width of the peripheral line, measured perpendicularly to a longitudinal axis (A-A') of extension of the application surface is less than 20% of the maximum width of the central region, measured perpendicularly to the axis of extension (A-A').

4. Applicator according to claim 2, wherein the maximum width of the peripheral line, measured perpendicularly to an axis (A-A') of extension of the application surface is less than 4 mm.

5. Applicator according to claim 2, wherein the application means comprise a gutter advantageously extending over the entire contour of the peripheral line.

6. Applicator according to claim 1, wherein the maximum width of the peripheral line, measured perpendicularly to a longitudinal axis (A-A') of extension of the application surface is less than 20% of the maximum width of the central region, measured perpendicularly to the axis of extension (A-A').

7. Applicator according to claim 6, wherein the maximum width of the peripheral line, measured perpendicularly to an axis (A-A') of extension of the application surface is less than 4 mm.

8. Applicator according to claim 6, wherein the application means comprise a gutter advantageously extending over the entire contour of the peripheral line.

9. Applicator according to claim 1, wherein the maximum width of the peripheral line, measured perpendicularly to an axis (A-A') of extension of the application surface is less than 4 mm.

10. Applicator according to claim 1, wherein the application means comprise a gutter advantageously extending over the entire contour of the peripheral line.

11. Applicator according to claim 1, wherein the application means comprise an absorbent surface advantageously arranged over the entire contour of the peripheral line.

12. Applicator according claim 1, wherein the application means are formed by an area having a wettability greater than the wettability of the central region, with the area extending advantageously over the entire contour of the peripheral line.

13. Applicator according to claim 1, wherein the application means comprise an assembly for dispensing cosmetic product on the peripheral line, with the applicator including a cosmetic product container connected to the dispensing assembly.

14. Applicator according to claim 1, wherein the central region is substantially solid.

15. Applicator according to claim 1, wherein the central region defines a cavity comprising an upper concave space and a lower concave space.

16. Applicator according to claim 1, wherein the central region and the peripheral line are covered with cosmetic product.

17. Applicator according to-claim 1, wherein the peripheral line comprises a lower segment with a substantially convex shape and an upper segment having two convex lateral regions convexes and a concave central recess.

18. Applicator for applying cosmetic product on the lips of a user, of the type including an application surface, the application surface having a central region and a peripheral contour line analogous to the contour of the lips of a human being, with the central region and the peripheral line being intended to receive the cosmetic product, wherein the peripheral line comprises means for preferred application of the cosmetic product on the lips of the user for applying, at the peripheral contour line, a mass per unit surface of cosmetic product that is greater than the mass per unit surface of cosmetic product applied in the central region, wherein the application means comprise an energy supply assembly on the peripheral line.

19. Method for applying cosmetic product on the lips of a user, including the following steps:

providing an applicator according to claim 1, with the central region and the peripheral line being covered with cosmetic product;

applying the application surface on the lips of a user;

depositing the cosmetic product on the lips of a user, with the surface mass of cosmetic produced deposited the peripheral contour line being greater than the surface mass of cosmetic product deposited in the central region.

20. Method according to claim 19, which comprises, before the provision step, the application by the user of a cosmetic product on the application surface.

* * * * *